US009154898B2

(12) United States Patent
Kim

(10) Patent No.: US 9,154,898 B2
(45) Date of Patent: Oct. 6, 2015

(54) SYSTEM AND METHOD FOR IMPROVING SOUND IMAGE LOCALIZATION THROUGH CROSS-PLACEMENT

(71) Applicant: Seon Joon Kim, Ulsan (KR)

(72) Inventor: Seon Joon Kim, Ulsan (KR)

( * ) Notice: Subject to any disclaimer, the term of this patent is extended or adjusted under 35 U.S.C. 154(b) by 147 days.

(21) Appl. No.: 14/090,228

(22) Filed: Nov. 26, 2013

(65) Prior Publication Data

US 2014/0301582 A1 Oct. 9, 2014

(30) Foreign Application Priority Data

Apr. 4, 2013 (KR) ..... 10-2013-0036740
Nov. 20, 2013 (KR) ..... 10-2013-0141537

(51) Int. Cl.
*H04R 5/02* (2006.01)
*H04S 7/00* (2006.01)
*H04S 1/00* (2006.01)

(52) U.S. Cl.
CPC *H04S 7/302* (2013.01); *H04S 1/002* (2013.01)

(58) Field of Classification Search
CPC ..... H04S 7/302; H04S 1/002
USPC ..... 381/17, 310, 303, 300, 307, 306
See application file for complete search history.

(56) References Cited

U.S. PATENT DOCUMENTS 7,386,139 B2 * 6/2008 Hashimoto et al. ..... 381/310

FOREIGN PATENT DOCUMENTS

JP 2005-142727 A 6/2005

* cited by examiner

*Primary Examiner* — Paul S Kim
(74) *Attorney, Agent, or Firm* — LRK Patent Law Firm

(57) ABSTRACT

A system and a method of improving sound image localization through cross-placement are provided. The system includes a first stereo system including a first left side speaker that is provided with a left side audio signal and a first right side speaker that is provided with a right side audio signal, and a second stereo system including a second left side speaker that is provided with a left side audio signal and a second right side speaker that is provided with a right side audio signal. The second right side speaker is provided adjacent to the first left side speaker and the second left side speaker is provided adjacent to the first right side speaker.

13 Claims, 10 Drawing Sheets

2.0 Channel (Stereo system)

5.1 Channel (Surround system)

Real environment 2.0 Channel (Stereo system)

SYSTEM AND METHOD FOR IMPROVING SOUND IMAGE LOCALIZATION THROUGH CROSS-PLACEMENT

BACKGROUND OF THE INVENTION

1. Field of the Invention

The present invention relates to a system of improving a sound image localization through cross-placement, and more particularly to a system of improving a sound image localization in which a second stereo system configured by a second left side speaker and a second right side speaker are cross-placed in relation to a first stereo system configured by a first left side speaker and a first right side speaker.

2. Description of the Prior Art

In acoustics, a sound image localization refers to a stereophonic sound technology that localizes a position of a specific sound source felt by a human to a virtual position. Specifically, a 2-channel stereo system has two sound source positions but a human perceives that a sound source position is located about halfway between the positions of speakers rather than at the position of each of the speakers. Typically, such a phenomenon refers to a sound image and when the sound image is clearly perceived, it is said that the sound image localization is good.

Meanwhile, a stereophonic sound technology may be classified into a sound recording technology and a reproducing technology. Audio systems related to the reproducing technology may be classified into three types of a mono system with 1.0 channel, a stereo system with 2.0 channels, and a surround system with 2.1 or more channels.

In that event, all the audio systems except the mono system have directionalities of left and right as illustrated in FIG. 1. That is, a sound image localization is implemented which has been intended by a sound source producer assuming that left side and right side speakers are placed left and right to be symmetrical to each other in identical reflection environments and the distances from a listener to the two speakers are equal.

In that event, the sound source refers to an electrical signal of a real sound which is recorded and edited and arrives at a speaker through a reproducing device and an amplifying device as an electrical signal.

However, as illustrated in FIG. 3, under a real condition, it is nearly impossible that the reflection environments of the left and right speakers are identical and the distances from the listener to the two speakers are also exactly equal to each other. Accordingly, it is difficult to implement a correct sound image localization.

Implementation of an ambience effect has been attempted by forming a 5.1-channel surround system, a 7.1-channel surround system or the like to increase the number of speakers and by arranging the speakers three-dimensionally around a listener. However, this may not be referred to as implementation of a sound image localization in exact meaning and increasing the number of speakers makes it rather difficult to implement a sound image localization well.

SUMMARY OF THE INVENTION

Accordingly, the present invention has been made to solve the above-mentioned problems occurring in the prior art, and an aspect of the present invention is to provide a system of improving a sound image localization through cross-placement which is capable of implementing a sound image localization even under a real condition regardless of a reflection environment, improving a sound image localization without needing to change a previously installed speaker or a position thereof, and being applied to a surround system with 2.1 or more channels which is based on an operation of speakers separately arranged at left and right sides as well as a stereo system.

Another aspect of the present invention is to provide a method of improving a sound image localization through cross-placement which is capable of implementing a sound image localization even under a real condition regardless of a reflection environment and improving a sound image localization without needing to change a previously installed speaker or a position thereof.

According to an aspect of the present invention, there is provided a system of improving a sound image localization through cross-placement. The system includes: a first stereo system including a first left side speaker that is provided with a left side audio signal and a first right side speaker that is provided with a right side audio signal, and a second stereo system including a second left side speaker that is provided with a left side audio signal and a second right side speaker that is provided with a right side audio signal. The first left side speaker and the first right side speaker are placed left and right to be symmetrical to each other with reference to a listener, and the second left side speaker and the second right side speaker are placed left and right to be symmetrical to each other with reference to the listener. The second right side speaker of the second stereo system is placed at the right side of the first left side speaker of the first stereo system, and the second left side speaker of the second stereo system is placed at the left side of the first right side speaker of the first stereo system. In addition, the distance (d) between the first left side speaker and the first right side speaker of the first stereo system is two or more times as large as each of the distance (d1) between the first left side speaker of the first stereo system and the second right side speaker and the second stereo system and the distance (d2) between the first right side speaker first stereo system and the second left side speaker of the stereo system.

In addition, the first left and right side speakers of the first stereo system may have a power that is higher than or equal to a power of the second left and right side speakers of the second stereo system.

Further, the first left and right side speakers of the first stereo system may be respectively identical to the second left and right side speakers of the second stereo system in acoustic property.

Moreover, the second left side speaker and the second right side speaker of the second stereo system may be identical to each other in acoustic property.

According to another aspect of the present invention, there is provided a method of improving a sound image localization of a first stereo system through cross-placement. The first stereo system includes a first left side speaker that is provided with a left side audio signal and a first right side speaker that is provided with right side audio signal, the first left side speaker and the first right side speaker being placed left and right to be symmetrical to each other with reference to a listener, with a distance (d) therebetween. The method includes: placing a second right side speaker of a second stereo system which is provided with a right side audio signal adjacent to the first left side speaker of the first stereo system, with a distance (d1) therebetween; and placing a second left side speaker of the second stereo system which is provided with a left side audio signal adjacent to the first right side speaker of the first stereo system, with a distance (d2) therebetween. The distance (d) between the first left side speaker and the first right side speaker of the first stereo system is two or more times as large as each of the distance (d1) between the first left side speaker of the first stereo system and the second right side speaker of the second stereo system and the distance (d2) between the first right side speaker of the first stereo system and the second left side speaker of the second stereo system.

According to the inventive system and method improving sound image localization through cross-placement, the sound image localization may be implemented under a real condition as well as an ideal condition regardless of left and right side reflection environments.

In addition, the sound image localization may be improved by crossly-placing speakers without needing to replace previously installed speakers themselves or change the positions thereof.

Further, the inventive system and method may be applied to a surround system with 2.1 or more channels based on an operation of speakers which are separated to left and right sides as well as a stereo system with 2.0 channels.

Moreover, the inventive sound image localization through cross-placement may be implemented in an area of headphone, earphone or a car audio system which may reproduce a sound, in which area.

DETAILED DESCRIPTION OF THE EXEMPLARY EMBODIMENTS

Hereinafter, the present invention will be described with reference to the accompanying drawings.

Figure 1:
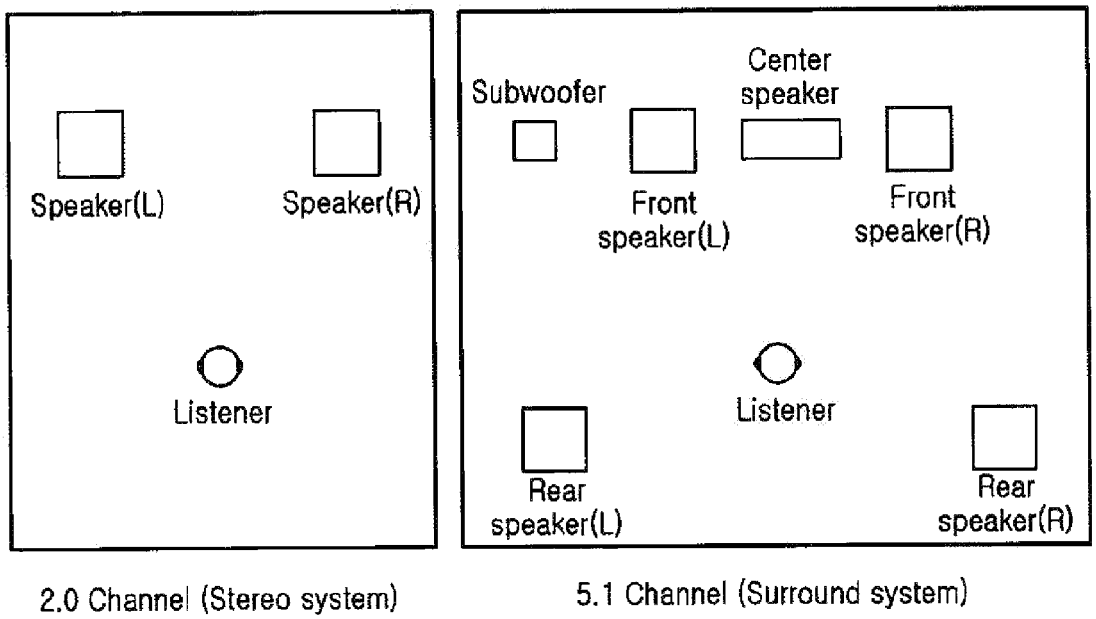
FIG. 1 RELATED ART
FIG. 1 illustrates a schematic view of a conventional stereophonic audio system.

As illustrated in FIG. 1, audio systems related to a stereophonic sound reproducing technology may be generally classified based on channels into three types of a mono system with 1.0 channel, a stereo system with 2.0 channels, and a surround system with 2.1 or more channels.

The present invention may be applied to a surround system with 2.1 or more channels which is based on an operation of speakers separately arranged at left and right sides as well as a stereo system with 2.0 channels and may also be applied to a front speaker and a rear speaker. However, for the convenience of description, the present invention will be described with reference to a stereo system with 2.0 channels.

Meanwhile, the present invention defines a stereo system as a system in which a left side speaker and a right side speaker that constitute the system are identical to each other in acoustic property and reproducing environments are symmetric to each other according to the ITU-R (International Telecommunication Union Radio communications Sector), Recommendation BS.1116.1. That is, it is defined that a pair of speakers are placed left and right to be exactly symmetrical to each other.

Here, the left and right side speakers refer to speakers that reproduce left and right side sound sources in the sound sources of the stereo system, respectively.

In addition, the acoustic properties include power (sound pressure level) (dB), impedance (Ω), and reproducing frequency band (Hz).

Figure 2:
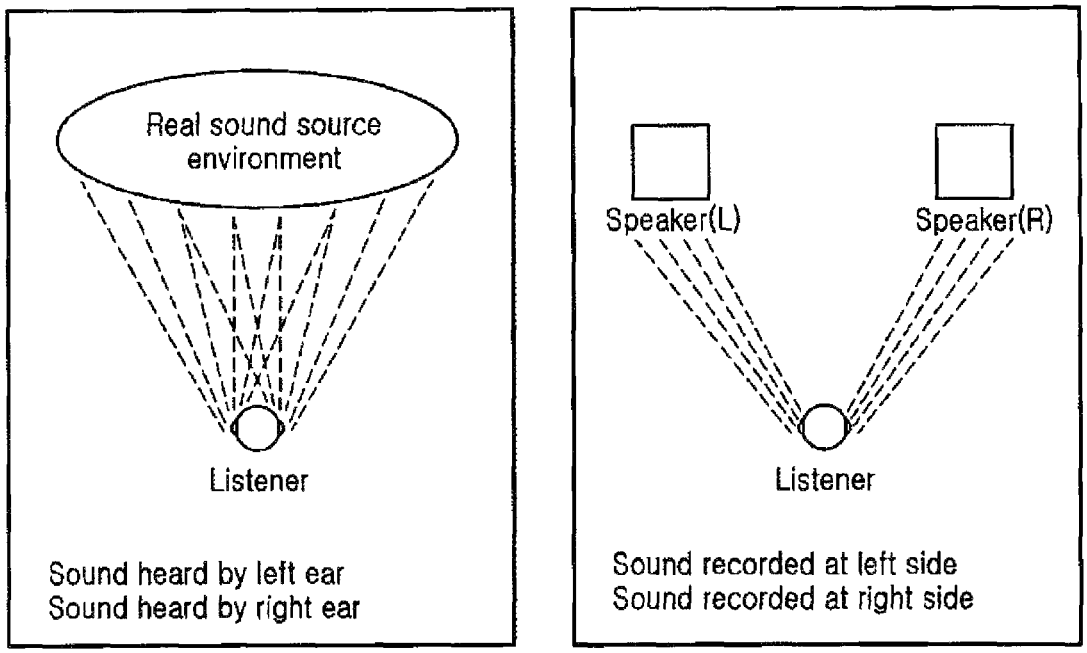
FIG. 2 RELATED ART
FIG. 2 illustrates conceptual views of sounds under a real environment and by a stereo system.

FIG. 2 illustrates a conceptual view of sounds under a real environment and by a stereo system. That is, when a sound source exists under a real environment, a human's ears hear all the sounds from opposite sides with reference to the human's face. However, due to the hindrance of the face, each of the left ear and the right ear may hear sounds from a direction corresponding thereto.

Meanwhile, the left and right side speakers of the stereo system mix left and right side sounds in a predetermined ratio and send the mixed sounds, using the situation of the real environment, so that the human's ears create an illusion.

Figure 3:
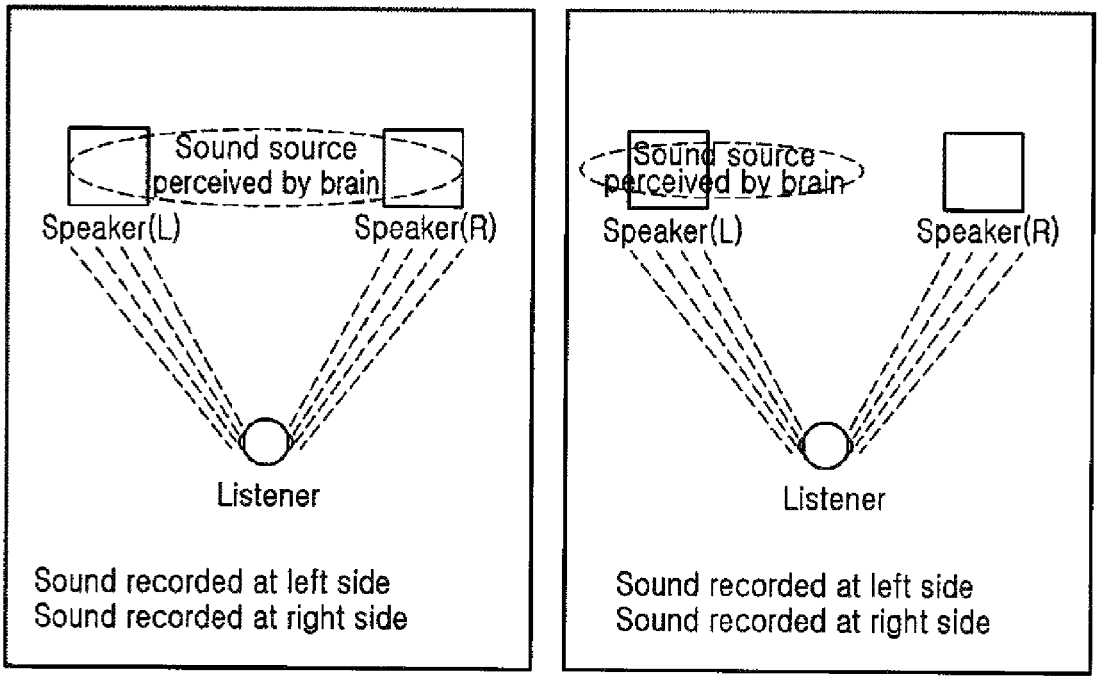
FIG. 3 RELATED ART
FIG. 3 illustrates conceptual views of sound sources by a stereo system under an ideal condition and under a real condition.

In that event, for a stereo system of an ideal condition in which the left and right side speakers are placed left and right to be symmetrical to each other in identical reflection environments and the distances from the listener to the two speakers are identical to each other as illustrated at the left half of FIG. 3, the human's brain that governs the human's ears perceives the space between the left and right side speakers as a sound source. When the sound source produced by the brain's illusion is perceived more clearly, the sound image localization is referred to as a better one.

In the stereo system under the real condition as illustrated at the right half of FIG. 3, the reflection environments around the left and right side speakers are not identical to each other and thus, the sound pressure at one side becomes higher than that at the other side. Accordingly, it is inevitable that the sounds heard by the human's ears are weighted to the sounds recorded at the one side. In such a case, the brain perceives the weighted side as a sound source so that the sound image localization is steeply deteriorated.

Figure 4:
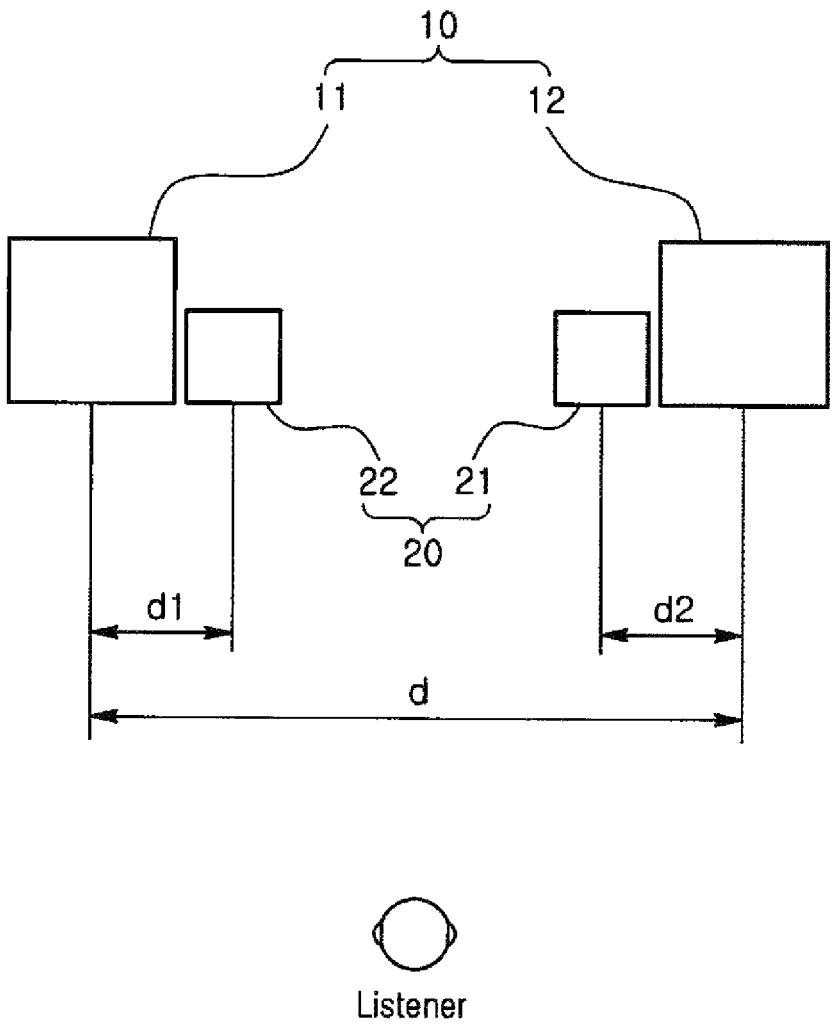
FIG. 4 illustrates a schematic view of the inventive system of improving a sound image localization through cross-placement.

In order to solve the above-mentioned problems, as illustrated in FIG. 4, the inventive system of improving a sound image localization through cross-placement includes a first stereo system 10 configured by a first left side speaker 11 and a first right side speaker 12 and a second stereo system 20 configured by a second left side speaker 21 and a second right side speaker 22 which are placed in such a manner that the second right side speaker 22 is provided at the right side of the first left side speaker 11 and the second left side speaker 21 is provided at the left side of the first right side speaker 12.

The human's brain perceives that a sound source exists in a direction where a sound is heard earlier. In addition, when the same sounds are simultaneously heard from different directions, the human's brain preferentially perceives a louder sound. Further, when sounds of various routes are heard from the same direction, the human's brain preferentially perceives the loudest sound. The inventive system of improving a sound image localization through cross-placement uses these basic principles as a basis.

In that event, it is premised on the assumption that the first left and right side speakers of the first stereo system 10 are identical to each other in acoustic property.

Further, the second stereo system 20 may be placed in addition to the first stereo system 10 which has been previously installed as well as reflected to the design at the initial stage.

Hereinafter, grounds that enable a sound image localization to be enabled regardless of a reflection environment will be presented.

Evaluation Equation of Reproduced Sound Image Localization $$S_P=S_O-(E_LP_L-E_RP_R)^2 \quad \text{[Equation 1]}$$

($S_P$ is a sound image localization at the time of reproducing, $S_O$ is a sound image localization of a sound source of the first stereo system, $E_L$ and $E_R$ are reflection environment variables around the first left and right side speakers, respectively, and $P_L$ and $P_R$ are acoustic properties of the first left and right side speakers of the first stereo system, respectively).

Here, the sound image localizations at the time of stereo reproducing under an ideal environment are as follows.

$$S_P=S_O \text{ because } E_L=E_R \text{ and } P_L=P_R, \quad \text{[Equation 2]}$$

Evaluation Equation of Sound Image Localization at the Time of Cross-Placement (Left Side)

$$\begin{aligned} S_L &= S_O-(E_LP_L-E_LP_{CR})^2 \\ &= S_O-E_L^2(P_L-P_{CR})^2 \end{aligned}$$

The speaker's acoustic property at the left side sound image localization at the time of cross-placement is as follows.

$$(P_L-P_{CR})=\frac{\sqrt{S_O-S_L}}{E_L}$$

(Right Side)

$$\begin{aligned} S_R &= S_O-(E_RP_{CL}-E_RP_R)^2 \\ &= S_O-E_R^2(P_{CL}-P_R)^2 \end{aligned}$$

The speaker's acoustic property at the right side sound image localization at the time of cross-placement is as follows:

$$(P_{CL}-P_R)=\frac{\sqrt{S_O-S_R}}{E_R}$$

$$\begin{aligned} S_{CP} &= S_O-\{E_L(P_L-P_{CR})-E_R(P_{CL}-P_R)\}^2 \\ &= S_O-\left\{E_L\frac{\sqrt{S_O-S_L}}{E_L}-E_R\frac{\sqrt{S_O-S_R}}{E_R}\right\}^2 \\ &= S_O-\left\{S_O-S_L+S_O-S_R-2\sqrt{(S_O-S_L)(S_O-S_R)}\right\} \\ &= S_L+S_R-S_O+2\sqrt{(S_O-S_L)(S_O-S_R)} \end{aligned}$$

($S_{CP}$ is a sound image localization at the time of cross-placement, $S_L$ and $S_R$ are sound image localizations of left and right sides at the time of cross-placement, $P_L$ and $P_R$ are acoustic properties of the first left and right side speakers of the first stereo system, and $P_{CL}$ and $P_{CR}$ are acoustic properties of the second left and right side speakers of the second stereo system).

In evaluating the sound image localizations of the sound image localization improving system, it may be appreciated that $E_L$ and $E_R$ (reflection environment variables) are cancelled each other and only $S_L$ and $S_R$ (left and right sound image localizations) and $S_O$ (a sound image localization of a sound source of the first stereo system) remain as variables.

Meanwhile, referring to the above-described equations, it may be appreciated that, as $(P_L-P_{CL})$ and $(P_{CL}-P_R)$ approach 0, $S_{CP}$ is increased. This means that an influence on sound image localizations in the sound image localization improving system is determined by the acoustic properties of the crossly placed speakers. Here, since the acoustic properties of the speakers include a power, the sound image localization may be implemented by tuning the powers of the cross-placed speakers.

Therefore, the sound image localization may be implemented regardless of the reflection environments of the left and right sides under a real condition as well as an ideal condition and the sound image localization may be improved by additionally crossly placing speakers without needing to replace the speakers themselves previously installed in the stereo system or change the positions thereof.

Specifically, a sound image localization improvement effect by cross-placement may be obtained by removing an effect on the reproduced sound image localization as much as possible. Through two stereo systems of left and right sides produced by introducing cross-placement, left and right sound image localizations sufficiently affected by reflection environment variables firstly appear and the reflection environment variables are removed and the sound image localizations substitute for the sound source of the existing stereo system, thereby removing the reflection environment variables. As a result, the loss of sound image localization caused by the reflection environment variables which may occur at a real reproducing environment is removed.

For reference, according to the ITO-R (International Telecommunication Union Radio Communications Sector), Recommendation ITU-R BS.1116.1, an ideal listening point of a stereo system is an apex opposite to the straight line interconnecting the left and right speakers in an equilateral triangle of which one side corresponds to the straight line.

Figure 5A:
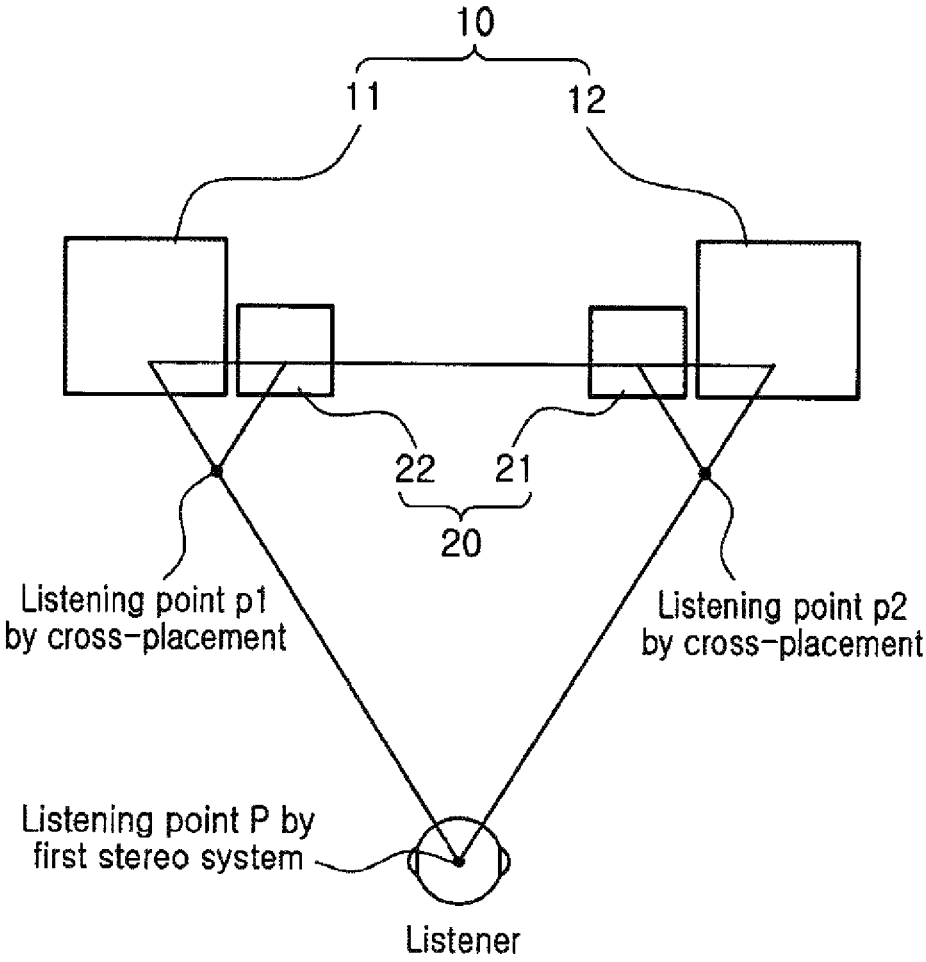
FIGS. 5A and 5B illustrate conceptual views of the inventive system of improving a sound image localization through cross-placement.
Figure 5B:
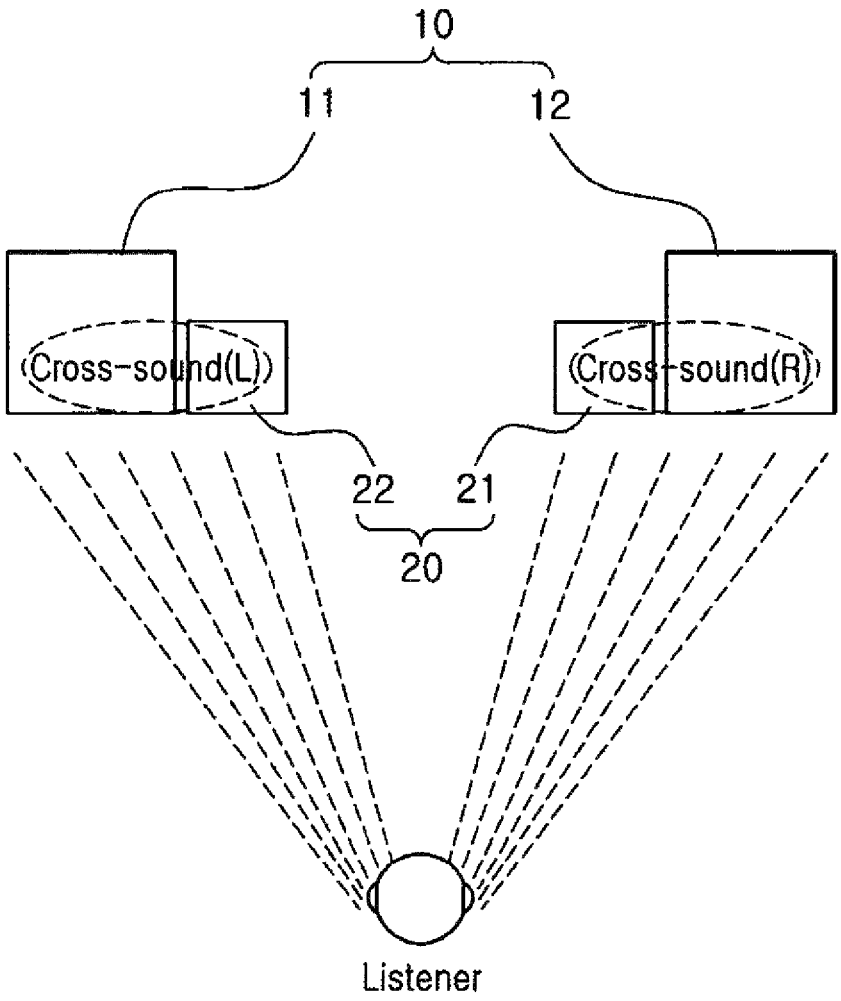

Thus, according to the present invention, as illustrated in FIG. 5A, a listening point P occurs by the first stereo system 10 and listening points p1 and p2 also occur at left and right sides by the first left and right side speakers 11 and 12 and second left and right side speakers 21 and 22, respectively.

On the contrary, no listening point occurs by the second stereo system 20 since the sound sources flow oppositely leftward and rightward. This state is referred to as a reversed sound image.

Here, it is desirable that the power of the first left and right side speakers 11 and 12 of the first stereo system 10 is higher than or equal to the power of the second left and right side speakers 21 and 22 of the second stereo system 20.

Meanwhile, in the present invention, it is assumed that the first stereo system 10 is a main sound source and the second stereo system 20 is an accessory sound source. This is because when the main-accessory relationship is changed, a reversed sound image is generated.

For this main-accessory relationship, the following conditions are required.

1) The power of crossly placed speakers is smaller than or equal to that of normally placed speakers.

2) The influence on a sound image by cross-placement is proportional to the power of crossly placed speakers. However, the power of the crossly placed speakers shall not be larger than the power of the normally placed speakers.

3) It is desirable that the powers of the left and right speakers in the crossly placed speakers are equal to each other.

Further, the first left and right side speakers 11 and 12 of the first stereo system 10 have acoustic properties which are the same as those of the second left and right side speakers 21 and 22 of the second stereo system 20.

This is because in Equation 2, $S_{CP}=S_O-\{E_L(P_L-P_{CR})-E_R(P_{CL}-P_R)\}^2$ and thus, a relationship of $S_{CP}=S_O$ is established.

Meanwhile, the second left side speaker 21 and the second right side speaker 22 of the second stereo system 20 may be identical to each other in acoustic property. However, as represented by Equation 2, it is not always good that $P_{CL}$ and $P_{CR}$ (acoustic properties) are identical to each other and it is desirable that $P_{CL}$ and $P_{CR}$ may be flexibly adjusted by $E_L$, and $E_R$ (reflection environment variables).

Accordingly, when the reflection environment variables are equivalent to each other, it is desirable that the acoustic properties of the second left side speaker 21 and the second right side speaker 22 of the second stereo system are identical to each other.

Further, the distance (d) between the first left side speaker 11 and the first right side speaker 12 of the first stereo system 10 should be considerably larger than the distance (d1) between the first left side speaker 11 of the M first stereo system 10 and the second right side speaker 22 of the second stereo system 20, and the distance (d2) between the first right side speaker 12 and the second left side speaker 21 (d>>d1, d2) and it is desirable that d is two or more times as large as each of d1 and d2.

When descriptions are made on Equation 2 with reference to the left side, Equation 2 is initially established assuming that $E_L$ (reflection environment variables) of $P_L$, and $P_{CR}$ are identical to each other. This is because $P_{CR}$ becomes rather close to $P_R$ when the distance (d) between the first left side speaker 11 and the first right side speaker 12 of the first stereo system 10 is not more than two times as large as the distance (d1) of the first left side speaker 11 of the first stereo system 10 and the second right side speaker 22 of the second stereo system 20.

Figure 6A:
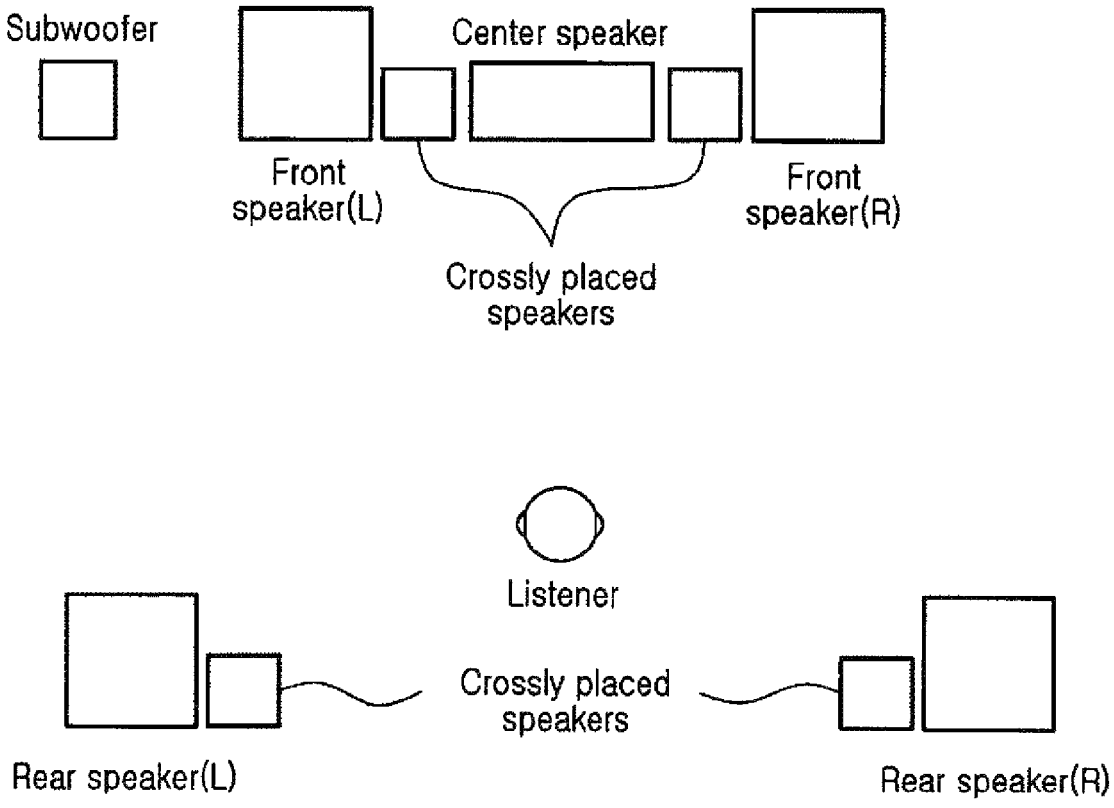
FIGS. 6A and 6B illustrate schematic views of the inventive system of improving a sound image localization through cross-placement which is implemented in a 5.1 channel surround system and a 7.1 channel surround system.
Figure 6B:
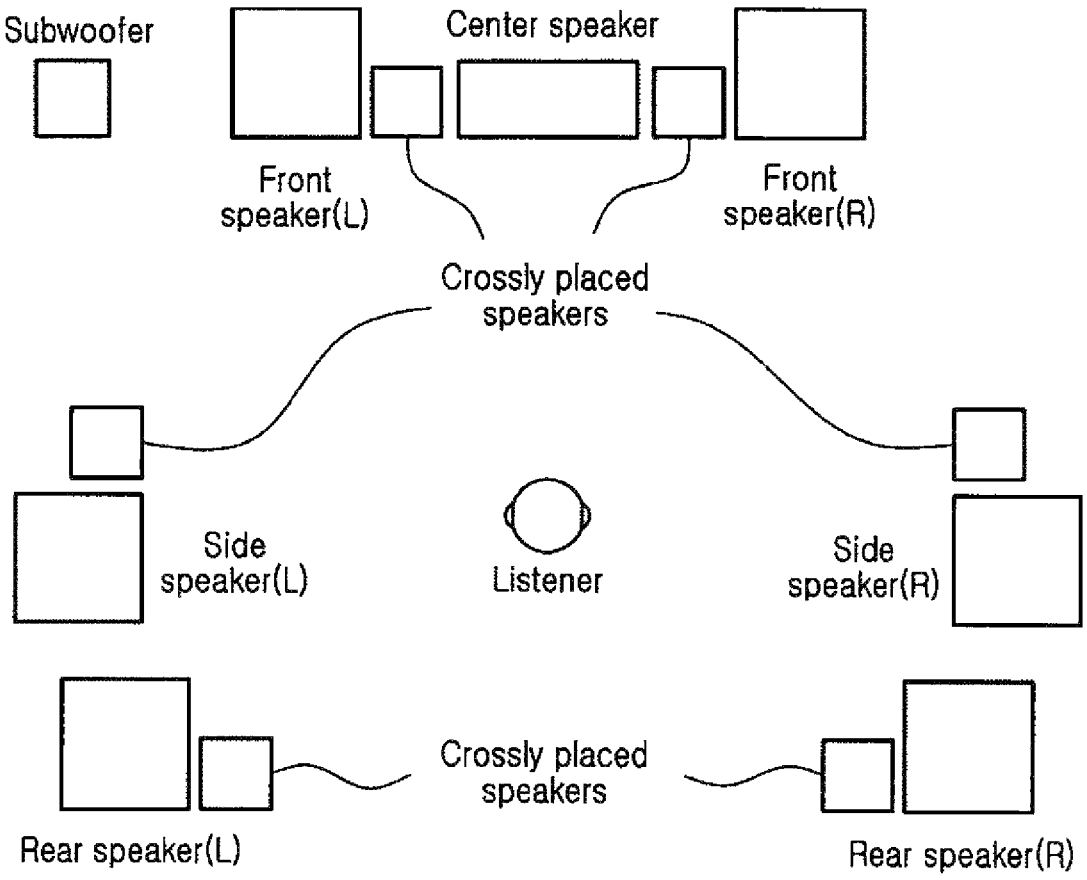

FIGS. 6A and 6B schematically illustrate the inventive system of improving sound image localization through cross-placement implemented in a 5.1-channel surround system and a 7.1-channel surround system in which the inventive system is applied not only to front speakers but also to rear speakers.

Meanwhile, FIGS. 5A and 5B and 6A and 6B illustrate that the left and right side speakers of the second stereo system are placed between the left and right side speakers of the first stereo system, i.e. on a virtual straight line that interconnects the first left side speaker and the first right side speaker of the first stereo system and between the first left side speaker and the first right side speaker of the first stereo system but the present invention is not limited thereto.

Figure 7:
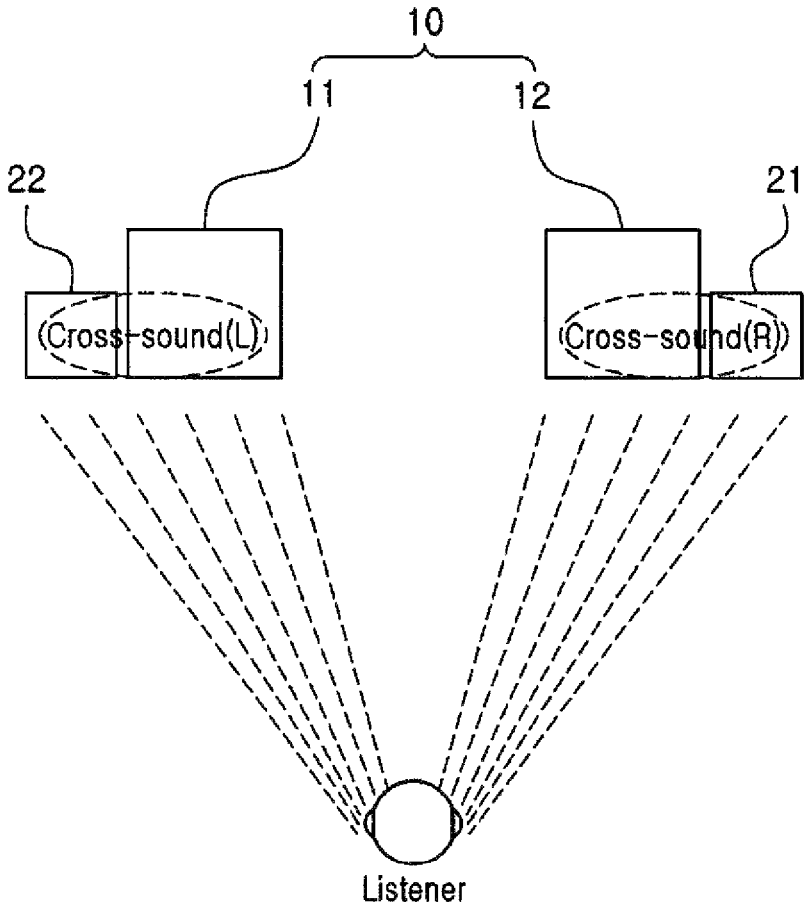
FIGS. 7 and 8 illustrate views of other exemplary embodiments of the inventive system of improving a sound image localization through cross-placement.

FIG. 7 illustrates that the left and right side speakers of the second stereo system are positioned outside the left and right side speakers of the first stereo system.

Figure 8:
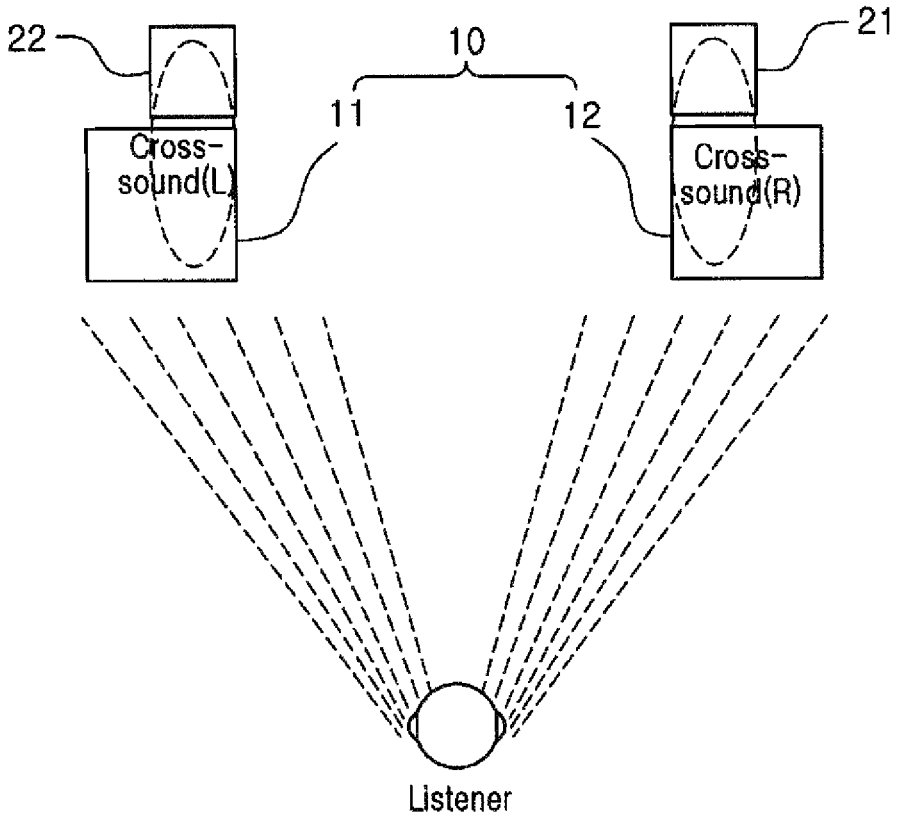

FIG. 8 illustrates that the left and right side speakers of the second stereo system are positioned upside the left and right side speakers of the first stereo system.

What is important in the exemplary embodiments illustrated in FIGS. 5 to 8 is that the distance (d) between the first left side speaker 11 and the first right side speaker 12 of the first stereo system 10 should be considerably larger than the distance (d1) between the first left side speaker 11 of the first stereo system and the second right side speaker 22 of the second stereo system and the distance (d2) between the first right side speaker 12 of the first stereo system and the second left side speaker 21 of the second stereo system (d>>d1, d2) and it is desirable that d is two or more times as large as each of d1 and d2.

As described above, the present invention may be applied to a surround system with 2.1 or more channels based on an operation of speakers which are separated to left and right sides as well as a stereo system with 2.0 channels.

Further, the speakers include a headphone, an earphone and a car audio system which may reproduce a sound, in which area, the inventive system of improving sound image localization through cross-placement may be implemented.

Although several exemplary embodiment of the present invention have been described for illustrative purposes, those skilled in the art will appreciate that various modifications, additions and substitutions are possible, without departing from the scope and spirit of the invention as disclosed in the accompanying claims.

What is claimed is:

1. A system of improving a sound image localization through cross-placement, the system comprising:

a first stereo system including a first left side speaker that is provided with a left side audio signal and a first right side speaker that is provided with a right side audio signal, the first left side speaker and the first right side speaker being placed left and right to be symmetrical to each other with reference to a listener; and a second stereo system including a second left side speaker that is provided with a left side audio signal and a second right side speaker that is provided with a right side audio signal, the second left side speaker and the second right side speaker being placed left and right to be symmetrical to each other with reference to the listener, wherein the second right side speaker of the second stereo system is placed at the right side of the first left side speaker of the first stereo system, and the second left side speaker of the second stereo system is placed at the left side of the first right side speaker of the first stereo system, and wherein the distance (d) between the first left side speaker and the first right side speaker of the first stereo system is two or more times as large as each of the distance (d1) between the first left side speaker of the first stereo system and the second right side speaker and the second stereo system and the distance (d2) between the first right side speaker of the first stereo system and the second left side speaker of the second stereo system.

2. The system of claim 1, wherein the first left and right side speakers of the first stereo system have a power that is higher than or equal to that of the second left and right side speakers of the second stereo system.

3. The system of claim 1, wherein the first left and right side speakers of the first stereo system are respectively identical to the second left and right side speakers in acoustic property.

4. The system of claim 1, wherein the second left side speaker and the second right side speaker of the second stereo system are identical to each other in acoustic property.

5. A system of improving a sound image localization through cross-placement, the system comprising:

a first stereo system including a first left side speaker that is provided with a left side audio signal and a first right side speaker that is provided with a right side audio signal, the first left side speaker and the first right side speaker being placed left and right to be symmetrical to each other with reference to a listener, with a distance (d) therebetween; and a second stereo system including a second left side speaker that is provided with a left side audio signal and a second right side speaker that is provided with a right side audio signal, the second left side speaker and the second right side speaker being placed left and right to be symmetrical to each other with reference to the listener, wherein the second right side speaker of the second stereo system is placed adjacent to the first left side speaker of the first stereo system, with a distance (d1) therebetween, and the second left side speaker of the second stereo system is placed adjacent to the first right side speaker of the first stereo system, with a distance (d2) therebetween, and wherein the distance (d) between the first left side speaker and the first right side speaker of the first stereo system is two or more times as large as each of the distance (d1) between the first left side speaker of the first stereo system and the second right side speaker of the second stereo system and the distance (d2) between the first right side speaker of the first stereo system and the second left side speaker of the second stereo system.

6. The system of claim 5, wherein the first left and right side speakers of the first stereo system have a power that is higher than or equal to that of the second left and right side speakers of the second stereo system.

7. The system of claim 5, wherein the first left and right side speakers of the first stereo system are respectively identical to the second left and right side speakers of the second stereo system in acoustic property.

8. The system of claim 5, wherein the second left side speaker and the second right side speaker of the second stereo system are identical to each other in acoustic property.

9. A method of improving a sound image localization of a first stereo system through cross-placement in which the first stereo system includes a first left side speaker that is provided with a left side audio signal and a first right side speaker that is provided with a right side audio signal, the first left side speaker and the first right side speaker being placed left and right to be symmetrical to each other with reference to a listener, with a distance (d) therebetween, the method comprising:

placing a second right side speaker of a second stereo system which is provided with a right side audio signal adjacent to the first left side speaker of the first stereo system, with a distance (d1) therebetween; and placing a second left side speaker of the second stereo system which is provided with a left side audio signal adjacent to the first right side speaker of the first stereo system, with a distance (d2) therebetween, and wherein the distance (d) between the first left side speaker and the first right side speaker of the first stereo system is two or more times as large as each of the distance (d1) between the first left side speaker of the first stereo system and the second right side speaker of the second stereo system and the distance (d2) between the first right side speaker of the first stereo system and the second left side speaker of the second stereo system.

10. The method of claim 9, wherein the left and right side speakers of the second stereo system are placed on a virtual straight line that interconnects the first left side speaker and the first right side speaker of the first stereo system and between the first left side speaker and the first right side speaker of the first stereo system.

11. The method of claim 9, wherein the left and right side speakers of the second stereo system are placed on a virtual straight line that interconnects the first left side speaker and the first right side speaker of the first stereo system and outside the first left side speaker and the first right side speaker of the first stereo system.

12. The method of claim 9, wherein the left and right side speakers of the second stereo system are placed upside the first left side speaker and the first right side speaker of the first stereo system.

13. The method of claim 9, wherein the sound image localization is improved by adjusting the powers of the second left side speaker and the second right side speaker.

* * * * *